US009151498B1

(12) United States Patent
Glidden

(10) Patent No.: US 9,151,498 B1
(45) Date of Patent: Oct. 6, 2015

(54) CONVEYOR OVEN IGNITER

(71) Applicant: James A. Glidden, Suttons Bay, MI (US)

(72) Inventor: James A. Glidden, Suttons Bay, MI (US)

( * ) Notice: Subject to any disclaimer, the term of this patent is extended or adjusted under 35 U.S.C. 154(b) by 377 days.

(21) Appl. No.: 13/842,374

(22) Filed: Mar. 15, 2013

(51) Int. Cl.
*F23Q 3/00* (2006.01)
*F23N 5/12* (2006.01)

(52) U.S. Cl.
CPC ..... *F23Q 3/008* (2013.01); *F23N 5/123* (2013.01); *F23Q 3/00* (2013.01)

(58) Field of Classification Search
CPC ..... F23Q 3/00; F23Q 3/008
USPC ..... 431/264
See application file for complete search history.

(56) References Cited

U.S. PATENT DOCUMENTS 5,938,428 A * 8/1999 Palmer et al. ..... 431/255
6,059,479 A * 5/2000 Clune ..... 403/24
6,808,389 B1 * 10/2004 Glidden ..... 431/264

* cited by examiner

*Primary Examiner* — Kenneth Rinehart
*Assistant Examiner* — Gajanan M Prabhu
(74) *Attorney, Agent, or Firm* — Robert L. Farris; Farris Law, P.C.

(57) ABSTRACT

An igniter mounting bracket is clamped to a ribbon burner tube by cap screws that are received in burner tube threaded bores. The threaded bores are in alignment with the axis and the elongated slot of the burner tube. A ground tube of the igniter has an insulator plug with an igniter tube bore on each tube end. A ground rod has one end welded to the ground tube. A hood with a hood free edge is on the other rod end. An ignition electrode passes through the igniter tube bores with an igniter tube axis. A threaded end of the electrode is connectable to a controller. An ignition portion parallel to and spaced from the hood free edge is on the other end of the electrode. The ground tube is received in a passage through the mounting bracket. The igniter tube axis is perpendicular to burner tube axis.

14 Claims, 5 Drawing Sheets

CONVEYOR OVEN IGNITER

TECHNICAL FIELD

This invention relates to apparatus adapted, for use in continuous conveyor ovens employed by commercial bakeries, for igniting a combustible fuel and for monitoring the presence of a flame.

BACKGROUND OF THE INVENTION

Commercial baking ovens include a large enclosed chamber with a continuous conveyor that conveys products to be baked through an oven inlet and conveys baked product through an oven outlet. The conveyor moves continuously. Additional product to be baked is added to keep the conveyor loaded at the inlet end. These ovens often have multiple zones. The oven temperature may change from one zone to the next. Each zone can employ several burners that extend from one side wall to another side wall and transverse to the direction of movement of product moving on the continuous conveyor.

The burners have a length that depends on the width of the continuous conveyor and the distance between the oven side walls. Large baking ovens may have burners that are more than sixteen feet long. The fuel burned by the burners may be natural gas, propane, butane or other combustible gases.

Product being baked midway between a near side and a far side of the continuous conveyor must be baked to the same extent as the product on both sides of the continuous conveyor. Product must be fully baked in the center and not over baked on bottom or top surfaces. Product that is over heated and darkened excessively is discarded.

Each burner, in a typical baking oven, has a burner tube. The burner tube has a gas receiving end that is anchored to a first sidewall of the oven. The tube has a tube slot on one side that extends at least the width of the conveyor. Gas passes through the slot and burns outside the tube adjacent to the slot. The heat produced by the burning gas heats the burner tube. The length of the burner tube increases as the temperature increases. The length of the burner tube decreases as the temperature decreases. The slot in the side of the burner tube weakens the slot side, of the burner tube. This weakened side of the burner tube expands pipe length more than the closed side as pipe temperature increases. The increased length of the slot side bows the burner tube about a vertical or substantially vertical axis. The free end of the burner tube adjacent to a second side wall of the oven is supported by a horizontal support beam. The horizontal support beam permits movement of the free end of the burner tube due to changes in tube length and due to bowing about a substantially vertical axis as a result of temperature changes in the burner tube. The free end of the burner tube extends to a position between second side wall and the continuous conveyor. The burner tube is also positioned below an upper run of the continuous conveyor and above a lower run of the continuous conveyor.

To obtain ideal product quality, baking ovens to have been equipped with control systems that adjust fuel flow rates, turn burners off and relight burners to obtain high quality baked products. Igniters employed in ovens have been introduced that control the distance between electrodes which create a spark and control the location of a spark relative to and a fuel port of a burner tube. Maintaining the spark gap distance and the position of the sparks relative to a burner is difficult. Burners move due to temperature changes. Igniter parts expand and contract due to temperature changes. Igniter parts have failed due to temperature changes over a period of time and failed to ignite a gas.

Failure of an igniter to ignite a burner results in the control system discontinuing the flow of fuel to the burner to prevent a possible explosion. Inspection and adjustment or repair of an igniter cannot take place in most ovens until unbaked and partially baked product is removed and the oven cools. The cost of lost product may be substantial. The down time and the cost of heating a cold oven can also be significant.

Igniters, that are currently used in baking ovens, have an outboard end that extends through the first oven wall and is pivotally supported by the oven wall. An inboard end of the igniter is supported by the burner tube. The igniters have an elongated tube that is parallel to the burner tube. The elongated igniter tube extends some distance into the oven to reach a position adjacent to the tube slot where combustion can be initiated. Some of these igniters work well. Other igniters do not work well. They generally require frequent maintenance and adjustment. The igniters used today are relatively long so that they can extend through the first side wall and into a position to ignite gas. Igniters employed in baking ovens are expensive due to their size, weight, and the need to accommodate movement of a burner in response to oven temperature changes.

SUMMARY OF THE INVENTION

The oven igniter includes a mounting bracket, a ground electrode assembly, and an ignition electrode assembly.

The mounting bracket includes a mounting plate. The mounting plate has an upper burner engaging bar and a lower burner engaging bar that is parallel to and spaced from the upper burner engaging bar. Both burner engaging bars are welded to the mounting plate or are an integral part of the mounting plate. The upper burner engaging bar and the lower burner engaging bar have burner engaging surfaces that engage a burner tube and hold the burner engaging surfaces parallel to a burner axis. One or two mounting bores pass through the mounting plate in space apart positions. The mounting bores are also centered between the upper burner engaging bar and the lower burner engaging bar. A tube is fixed to the mounting plate below the lower burner engaging bar. The tube can be welded to a rear surface of the mounting bar or a bottom edge of the mounting plate. The tube has an igniter passage bore that is transverse to the burner axis and spaced from the burner axis. The igniter passage bore continues through the mounting plate when the tube is welded to the rear surface of the mounting bar. A threaded bore passes through the tube.

The ground electrode assembly includes an electrical conductive tube with a tube axis, a tube outside surface, a tube front end, and a tube rear end. A ground rod is welded to the tube outside surface and extends parallel to the tube axis past the tube front end to a ninety degree bend in the ground rod. A free end portion of the ground rod extends, from the ninety degree bend, through the tube axis. A sheet metal hood is welded to the free end portion of the ground rod. The sheet metal hood is shaped to include a hood portion that extends toward the axis and the tube front end. A hood free edge, of the hood portion, is transverse to the tube axis and faces toward the tube front end.

A rear plug, made from material that does not conduct electricity, has a rear central igniter rod bore. The rear plug is mounted on the tube rear end with a rear central igniter rod bore concentric with the tube axis. A front plug, made from material that does not conduct electricity, has a front central igniter rod bore. The front plug is mounted on the tube front end with the front central igniter rod bore concentric with the tube axis. The front plug is non-rotatable relative to the tube. A transverse recess extends across the front central igniter rod bore of the front plug.

The ignition electrode assembly includes an ignition rod with an elongated first ignition rod portion. The elongated first ignition rod portion has a threaded end. A bore through the first ignition rod portion is spaced from the threaded end. A pin extends through the bore through the elongated first ignition rod portion. At least two bends are provided in the ignition rod and an ignition rod portion with an ignition rod forward end that is parallel to and spaced from the hood free end. The threaded end of the ignition rod passes through the front central igniter rod bore of the front plug and the rear central igniter rod bore of the rear plug. The pin in the bore through the ignition rod is received in the transverse recess in the front plug. A compression coil spring is mounted on the threaded end of the ignition rod and compressed between the rear plug and an adjustment nut on the threaded end. A lock nut on the threaded end holds the adjustment nut in a selected position.

a portion of the rear plug and a portion of the electrical conductive tube extend through the igniter passage bore through the tube of the mounting bracket. A set screw, received in the threaded bore through the tube fixed to the mounting plate, engages the electrical conductive tube of the ground electrode assembly and holds the ground electrode assembly in selected position relative to a burner gas discharge slot.

The tube axis of the electrical conductive tube is transverse to and below the lower burner engagement surface on the mounting plate. The tube axis of the electrical conductive tube is also transverse to and below a burner axis at the location of connection of the mounting bracket.

BRIEF DESCRIPTION OF DRAWINGS

The presently preferred embodiment of the invention is disclosed in the following description and in the following drawings, wherein.

DETAILED DESCRIPTION OF THE PREFERRED EMBODIMENTS

Figure 1:
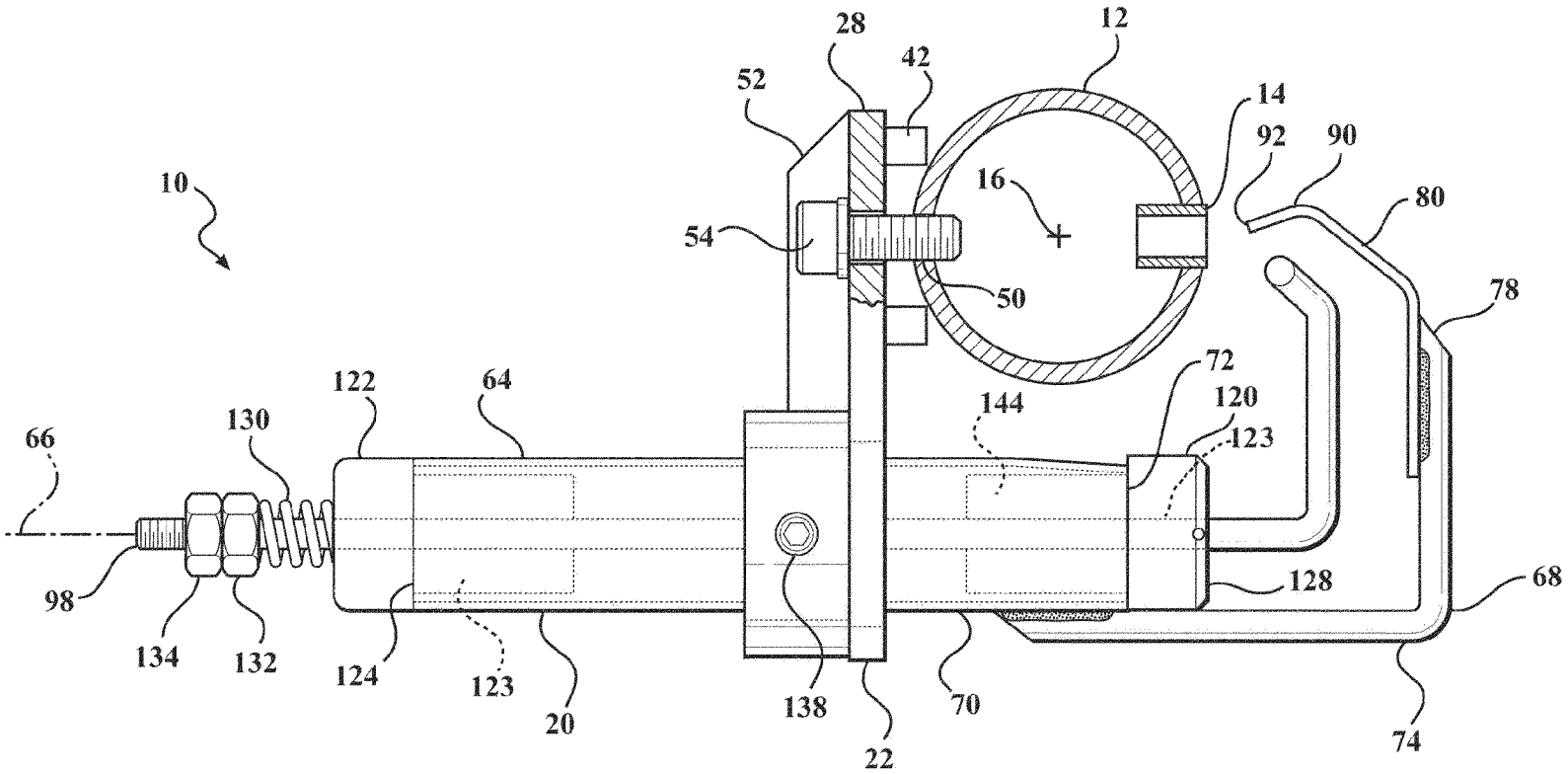
FIG. 1 is a side elevational view of an igniter as assembly mounting on an oven burner.
Figure 3:
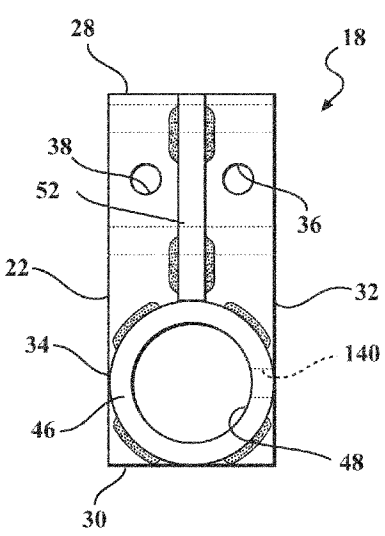
FIG. 3 is a rear elevational view of the mounting bracket.
Figure 2:
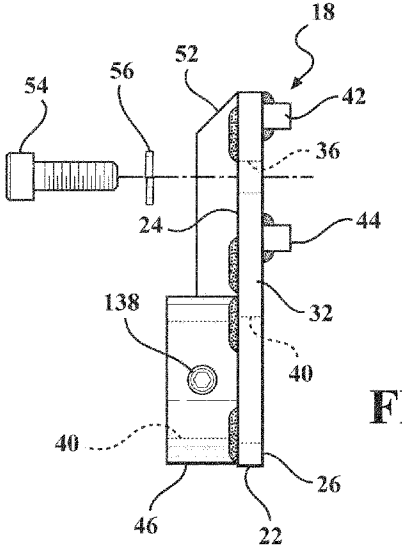
FIG. 2 is an expanded side elevational view of the igniter mounted bracket.
Figure 4:
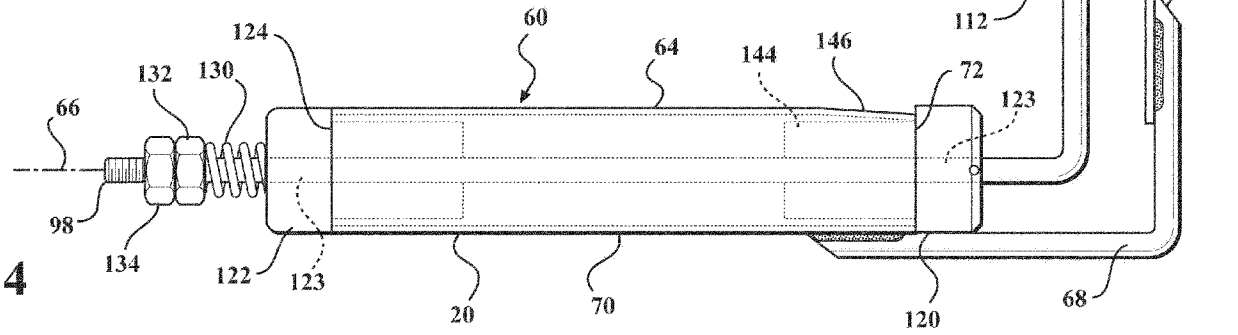
FIG. 4 is a side elevational view of the igniter.
Figure 7:
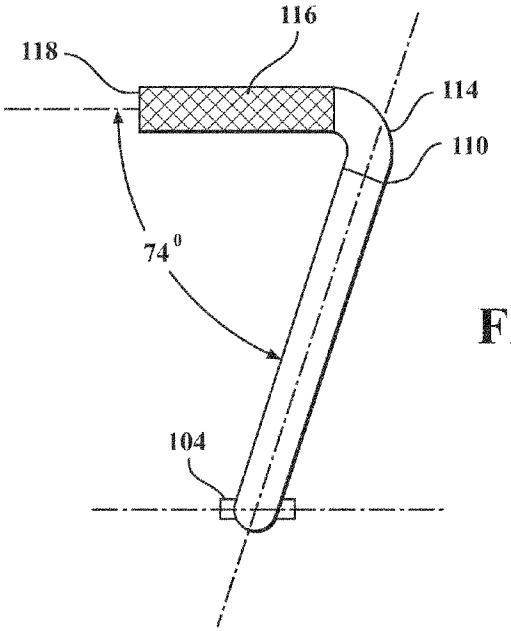
FIG. 7 is a front elevational view of the ignition electrode assembly.
Figure 6:
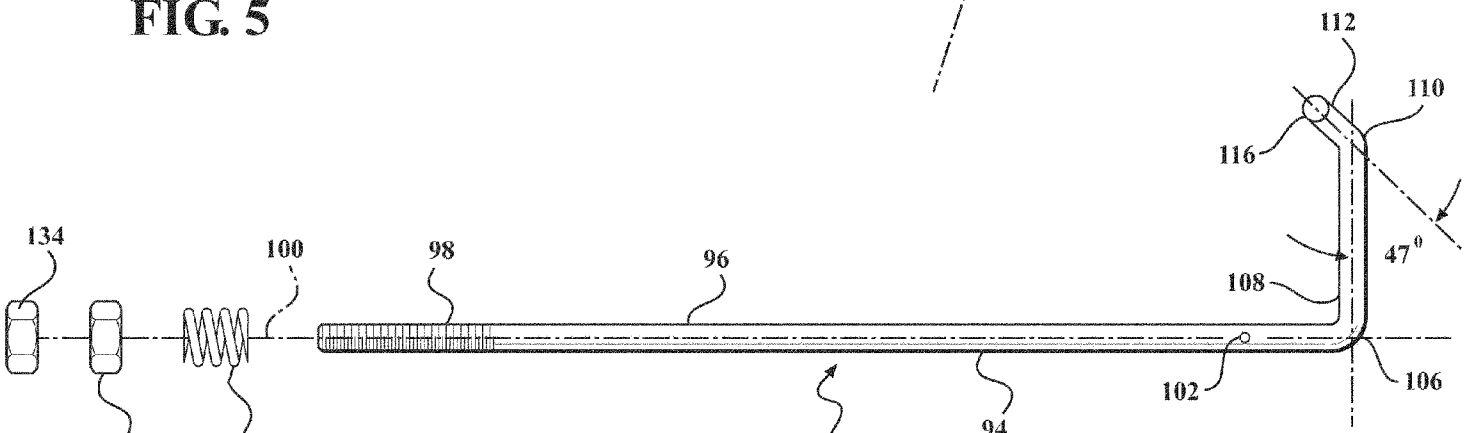
FIG. 6 is an expanded side elevational view of the ignition electrode assembly.
Figure 5:
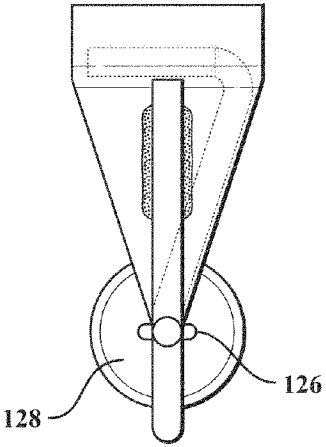
FIG. 5 is a front elevational view of the igniter.
Figure 9:
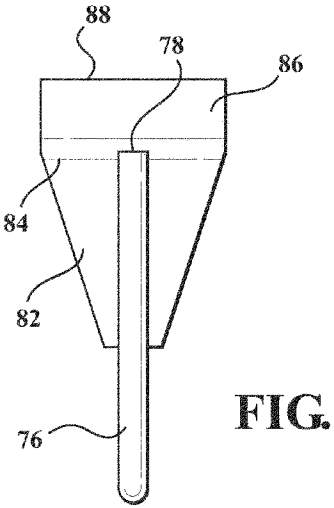
FIG. 9 is a front elevational view of the ground electrode assembly.
Figure 10:
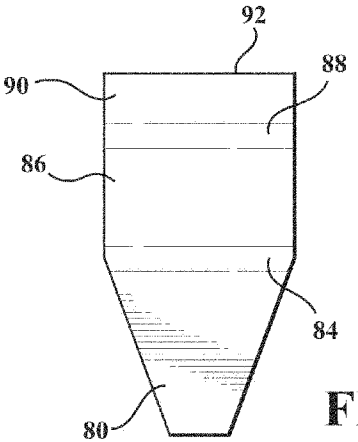
FIG. 10 is a plan view of a hood plate.
Figure 8:
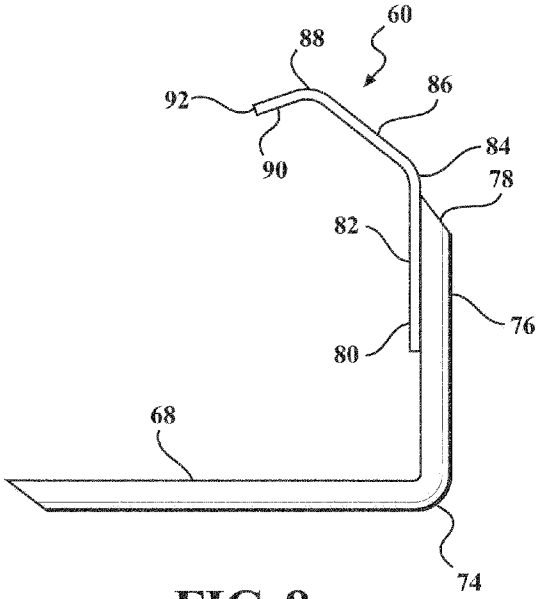
FIG. 8 is a side elevational view of the ground electrode assembly.
Figure 11:
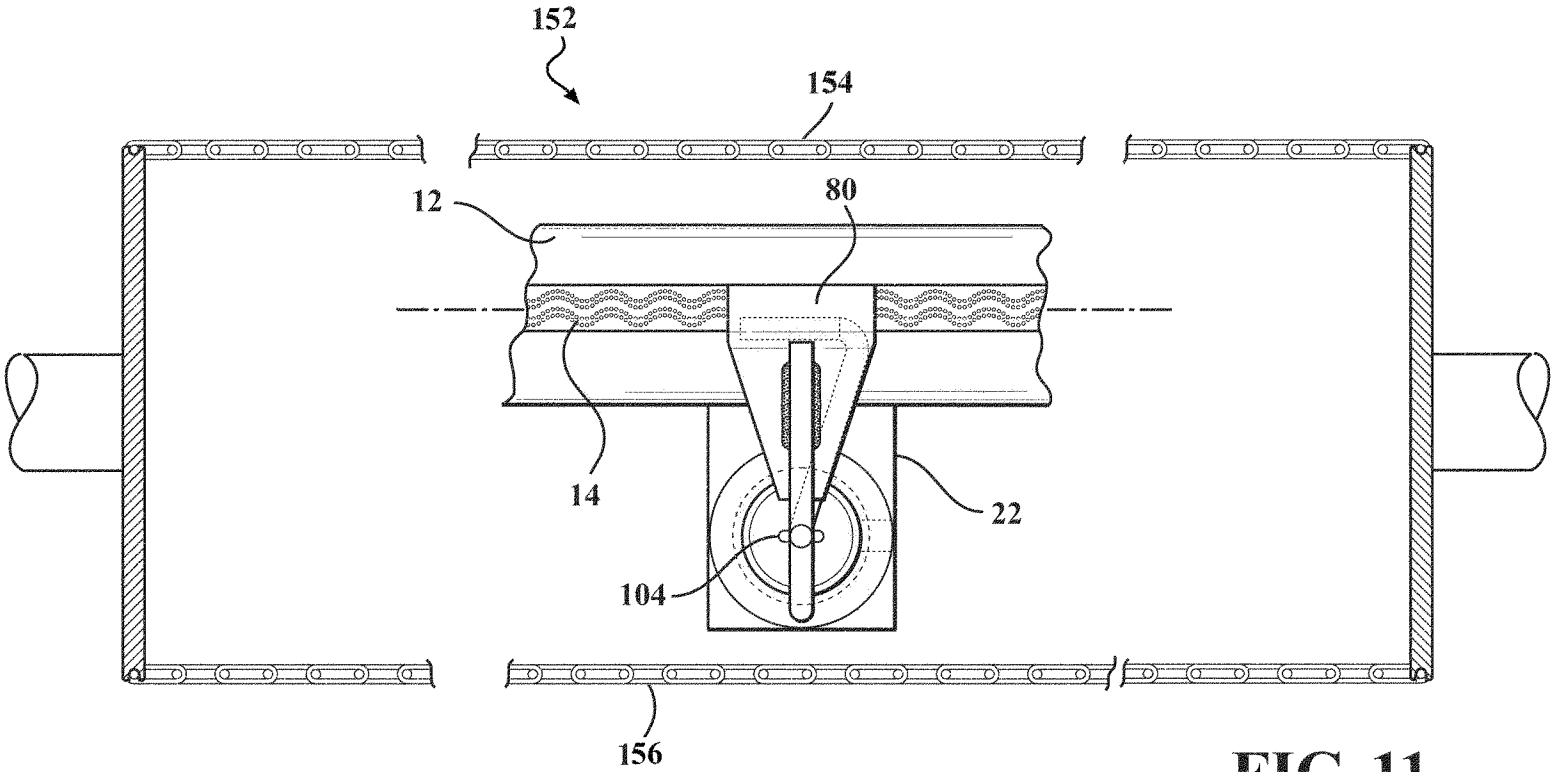
FIG. 11 is a front elevational view of the igniter mounted on a burner with parts broken away.

The igniter assembly 10, as shown in FIG. 1, is mounted on a burner tube 12, inside a baking oven. The burner tube 12 as shown is an elongated pipe with a circular cross section and a slot 14 for the passage of air and combustible gas from the burner tube 12. The burner tube 12 has an elongated burner axis 16 that is coaxial with the burner tube. These burners with burner tubes 12 with elongated slots 14 are referred to as ribbon burners. Ribbon burners are employed in bakery ovens for adding heat from one side wall to another side wall and along the entire length of the burner tube at a substantially uniform selected rate. The burner tubes 12 of ribbon burners tend to bow with temperature increases and to straighten with temperature decreased. Bowing and straightening occurs because the elongated slot 14 weakens the tube and permits increased metal expansion and contraction.

The igniter assembly 10 includes an igniter mounting bracket 18 and an igniter 20. The mounting bracket 18 includes a mounting plate 22. The mounting plate 22 has a rear side 24, a front side 26, a top edge 28, a bottom edge 30, a first side edge 32 and a second side edge 34. Two mounting bores 36 and 38 pass through the mounting plate 22 from the rear side 24 to the front side 26. An igniter passage bore 40 passes through the mounting plate 22 from the rear side 24 to the front side 26. An upper burner engaging bar 42 and a lower burner engaging bar 44 are welded to the front side 26 of the mounting plate 22 and are spaced equal distances from the mounting bores 36 and 38. A tube 46, with a passage 48 that is coaxial with the igniter passage bore 40, is welded to the rear side 24 of the mounting plate 22. A pair of threaded bores 50 passes through the burner tube 12. A reinforcing bar 52 is welded to the rear side 24 of the mounting plate 22 and to the tube 46, and extends between the mounting bores 36 and 38. Cap screws 54 with lock washers 56 pass through each of the mounting bores 36 and 38 from the rear side 24 to the front side 26 and screw into the threaded bores 50 in the burner tube 12. The cap screws 54 hold the spaced apart upper and lower burner engaging bars 42 and 44 in engagement with the burner tube 12 and parallel to the elongated burner axis 16.

The igniter 20 includes a ground electrode assembly 60 and an ignition electrode assembly 62. The ground electrode assembly 60 includes an electrically conductive tube 64 with a tube axis 66. A ground rod 68 is welded to the outside surface 70 of the conductive tube 64. The ground rod 68 extends parallel to the tube axis 66 and past the tube front end 72 to a rod ninety degree bend 74. The free end 76 of the ground rod 68 extends from the bend 74 perpendicular to the tube axis 66 and through the tube axis to a ground rod end 78. A hood 80 of flat sheet metal is welded to the ground rod 68. A first portion 82 of the hood 80 extends perpendicular to the tube axis 66 to a first hood bend 84 adjacent to the ground rod end 78. A second portion 86 of the hood 80, extends from the first hood bend 84 away from the tube axis 66 and toward the tube front end 72 to a second head bend 88. A third portion 90 of the hood 80 extends from the second hood bend 88 toward the tube axis 66 and toward the tube front end 72 to a hood free edge 92. The hood free edge 92 is transverse to the tube axis 66 and faces toward the tube front end 72.

The ignition electrode assembly 62 includes an ignition rod 94 with an elongated first ignition rod portion 96. The first ignition rod portion 96 has a threaded end 98. The first ignition rod portion 96 also has an ignition rod axis 100. A bore 102 through the first ignition rod portion 96 receives a short roll pin 104. The roll pin 104 is perpendicular to the ignition rod axis 100. A ninety degree bend 106 is provided in the first ignition rod portion 96 on the opposite end of the first ignition rod portion 96 from the threaded end 98. A second ignition rod portion 108 extends radially to a second bend 110. A third ignition rod portion 112 extends radially outward relatively to the ignition rod axis 100 and toward the threaded end 98 to a third bend 114. A forth ignition rod portion 116 extends from the third bend 114 to an ignition rod forward end 118. The forth ignition rod portion 116 is transverse to the ignition rod axis 100.

A front plug 120 is mounted is mounted on the tube front end 72. A rear plug 122 is mounted on the tube rear end 124 of the electrically conductive tube 64. Both plugs 120 and 122 are made from material that does not conduct electricity. Both plugs 120 and 122 have central igniter rod bores 123 that are concentric with the tube axis 66. The front plug 120 has a transverse recess 126 in a front surface 128 that intersects the ignition rod axis 100. A cylindrical portion 144 of each plug 120 and 122 extends into the electrical conductive tube 64. These cylindrical portions 144 hold tube axis 66 coaxial with the igniter rod bores 123 in the plugs 120 and 122. The tube front end 72 has a depression 146 in the outside surface 70 that engages the cylindrical portion 144 of the front plug 120 to hold the transverse recess 126 in a horizontal position.

The threaded end 98 of the first igniter rod portion 96 passes through the front plug 120 and the rear plug 122. The roll pin 104 is received in the recess 126 in the front plug 120. A compression coil spring 130 is received on the threaded end 98 of the ignition rod 94. An adjustment nut 132 is screwed on the threaded end 98 of the ignition rod 94. The tension on the coil spring 130 is adjusted to load the roll pin 104 and tension the first ignition rod portion 96 when the igniter assembly 10 is at maximum operating temperature as well as when the igniter assembly is at a minimum ambient temperature. The adjustment nut 132 is adjusted to insure that the coil spring 130 is partially compressed at all times and that the coil spring is not fully compressed at any temperature. A lock nut 134 holds the adjustment nut 132 in a selected position.

The forth ignition rod portion 116 and hood free edge 92 are parallel to each other and separated a correct distance to provide reliable and strong sparks. The surface of the forth ignition rod portion 116 is knurled to enhance reliability and strength of the sparks. The air gap between hood free edge 92 and the forth ignition rod portion 116 depends on the positions of the roll pin 104 and the tube front end 72. The length of ground electrode assembly 60 and the length of the ignition electrode assembly 62 forward of the tube front end 72 of the electrically conductive tube 64 are relatively short. Thermal changes of the positions of hood fee edge 92 and the ignition rod portion 116 relative to the tube axis 66 in an axial direction is minimized.

Both assemblies 60 and 62, forward the tube front end 72 are exposed to about the same temperatures. Both electrode assemblies will expand and contract at about the same rate thereby maintaining the spark gap.

The igniter 20 is inserted into the igniter passage bore 40 of the igniter mounting bracket 18. The igniter 20 is rotated about the igniter rod axis 100 to position the forth ignition rod portion 116 and the hood free edge 92 parallel to the burner slot 14. The igniter 20 is moved axially in the mounting in the igniter passage bore 40 to adjust the distance between the sparks and the burner slot 14. With the hood 80 holding air and gas adjacent to the spark gap, ignition is generally reliable. The hood 80 also facilitates a relatively large variation in the distance between the slot 14 in the burner tube 12 and the air gap between the hood free edge 92 and the forth ignition rod portion 116. Once the air gap between the hood free edge 92 and the forth ignition rod portion 116 is properly positioned relative to the slot 14 in the burner tube 12, a set screw 138 in a threaded bore 140 through the tube 46, is tightened to engage the electrically conductive tube 64 and hold the igniter 20 in a selected position relative to the burner tube 12.

The burner tube 12 is a portion of the electrical ground electrode. The hood free edge 92 is connected to the burner tube 12 electrically through the upper burner engaging bar, the lower burner engaging bar 44, the mounting plate 22, the tube 46, the set screw 138 and the ground electrode assembly 60 of the ignition electrode assembly 62. A high temperature current conductor (not shown) is connected to threaded end 98 of the ignition rod 94 adjacent to the lock nut 134. The high temperature current conductor extends from the ignition rod 94 to a controller and power source (not shown) outside of the baking oven chamber that the continuous oven conveyor 152 passes through. The conveyor 152 has an upper run 154 that carries product to be baked, and a return lower run 156.

The forth ignition rod portion 116 is positioned adjacent to the slot 14 in the burner tube 12 and in a flame when gas and air passing through the slot 14 is ignited. When the forth ignition rod portion 116 and the hood free edge 92 are within the flame, a circuit is established that indicates the presence of a flame.

The hood free edge 92 and ignition rod portion 116 remain parallel to each other and to the elongated burner axis 16 between the two threaded bores 50 that receive the cap screws 54 during oven temperature changes. The upper burner engaging bar 42 and the lower burner engaging bar 44 together with the two cap screws 54 limit bowing of the burner tube 12 between the threaded bores 50. Limiting bowing, due to temperature changes, reduces the need to retighten the cap screws 54.

The upper burner engaging bar 42 and the lower burner engaging bar 44 hold the tube axis 66 perpendicular to the burner axis 16 at the location of connection to the burner tube 12. The tube axis 66 is also below the burner axis 16. The igniter assembly 10 can be mounted at any location along the length of the slot 14 in the burner tube. The threaded bores 50 are formed by guiding a drill bit through the slot 14 and drilling two bores through the burner tube 12. Threads are cut in the two bores. The threaded bores 50 are aligned with the elongated burner axis 16 by the drill bit guide.

I claim:

1. A conveyor oven igniter comprising:

a mounting bracket including a mounting plate, an upper burner engaging bar fixed to the mounting plate, a lower burner engaging bar fixed the mounting plate parallel to and spaced from the upper burner engaging bar, at least one mounting bore through the mounting plate centered between the upper burner engaging bar and the lower burner engaging bar, a cap screw passing through the at least one mounting bore through the mounting plate, a burner threaded bore receives the at least one cap screw and clamps the upper burner engaging bar and the lower burner engaging bar to a burner tube in a position in which the upper burner engaging bar and the lower burner engaging bar engage the burner tube in areas which are parallel to a burner axis, and a tube fixed to the mounting plate below the lower burner engaging bar, an igniter passage bore through the tube, and a threaded bore through the tube fixed to the mounting plate;

a ground electrode assembly including an electrical conductive tube with a tube axis, a tube outside surface, a tube front end and a tube rear end, a ground rod welded to the tube outside surface and extending parallel to the tube axis past the tube front end, a bend in the ground rod, a ground rod free end portion, a sheet metal hood welded to the ground rod and shaped to include a hood portion that extends toward the tube axis and the tube front end to a hood free edge that is transverse to the tube axis and faces toward the tube front end;

a rear plug made from material that does not conduct electricity, having a central igniter rod bore that is concentric with the tube axis and, mounted on the tube rear end;

a front plug made from material that does not conduct electricity, having a central igniter rod bore that is concentric with the tube axis, a transverse recess extending across the central igniter rod bore of the front plug and wherein the front plug is mounted on the tube front end;

an ignition electrode assembly including an ignition rod with an elongated first ignition rod portion with a threaded end, a bore through the ignition rod and spaced from the threaded end, a pin extending through the bore through the ignition rod, at least two bends in the ignition rod and an igniter rod portion with an igniter forward end that is parallel to and spaced from the hood free edge;

wherein the threaded end of the ignition rod passes through the central igniter rod bore of the front plug and the central igniter rod bore of the rear plug, the pin in the bore through the ignition rod received in the transverse recess in the front plug, a compression coil spring mounted on the threaded end of the ignition rod, compressed between the rear plug and an adjustment nut on the threaded end and a lock nut on the threaded end holding the adjustment nut in a selected position;

wherein the rear plug and a portion of the electrical conductive tube extends through the igniter passage bore through the tube of the mounting bracket, and a set screw received in the threaded bore through the tube fixed to the mounting plate and with the set screw engaging the electrical conductive tube of the ground electrode assembly and holding the igniter rod portion with the igniter forward end and the hood free edge of the ground electrode assembly in selected positions relative to the burner tube, and wherein the tube axis of the electrical conductive tube is transverse to and below the burner axis.

2. A conveyor oven igniter, as set forth in claim 1, wherein an axis of the burner threaded bore intersects the burner axis and extends through a burner slot in the burner tube and the cap screw received in the at least one mounting bore and is aligned with the burner slot.

3. A conveyor oven igniter, as set forth in claim 1, wherein the bend in the ground rod is a ninety degree bend and the ground rod free end portion is intersected by the tube axis of the electrical conductive tube.

4. A conveyor oven igniter, as set forth in claim 1, wherein a first bend, of the at least two bends in the ignition electrode assembly, is a ninety degree bend.

5. A conveyor oven igniter, as set forth in claim 1, wherein the conveyor oven igniter functions as a burner flame sensor when there is burning gas between the hood free edge of the ground electrode assembly and the igniter forward end, thereby forming a circuit between the ground electrode assembly and the ignition electrode assembly.

6. A conveyor oven igniter, as set forth in claim 1, wherein the front plug includes a cylindrical portion that extends into the electrical conductive tube and the electrical conductive tube is pressed to engage the cylindrical portion and prevent rotation of the plug relative to the electrical conductive tube.

7. A conveyor oven igniter comprising:

a mounting bracket including a mounting plate, an upper burner engaging surface on the mounting plate, a lower burner engaging surface on the mounting plate parallel to and spaced from the upper burner engaging surface, at least two spaced apart mounting bores through the mounting plate and centered between the upper burner engaging surface and the lower burner engaging surface, a first cap screw passing through a first one of the at least two space apart mounting bores and received in a first burner tube threaded bore, a second cap screw passing through a second one of the at least two space apart mounting bores and received in a second burner tube threaded bore, a tube fixed to the mounting plate below the lower burner engaging surface, an igniter passage bore through the tube fixed to the mounting plate, and a threaded bore through the tube fixed to the mounting plate;

a ground electrode assembly including an electrical conductive tube with a tube axis, a tube outside surface, a tube front end and a tube rear end, a ground rod welded to the tube outside surface and extending parallel to the tube axis past the tube front end, a bend in the ground rod, a ground rod free end portion, a sheet metal hood welded to the ground rod and shaped to include a hood portion that extends toward the tube axis and the tube front end to a hood free edge that is transverse to the tube axis and faces toward the tube front end;

a rear plug made from material that does not conduct electricity, having a rear central igniter rod bore that is concentric with the tube axis and, mounted on the tube rear end;

a front plug made from material that does not conduct electricity, having a front central igniter rod bore that is concentric with the tube axis, a transverse recess extending across the central igniter rod bore of the front plug and wherein the front plug is mounted on the tube front end with the transverse recess in a fixed position relative to the electrical conductive tube;

an ignition electrode assembly including an ignition rod with an elongated first ignition rod portion having a threaded end, a bore through the ignition rod and spaced from the threaded end, a pin extending through the bore through the ignition rod, at least two bends in the ignition rod and an ignition rod portion with an ignition rod forward end that is parallel to and spaced from the hood free edge;

wherein the threaded end of the ignition rod passes through the front central igniter rod bore of the front plug and the rear central igniter rod bore of the rear plug, the pin in the bore through the ignition rod received in the transverse recess in the front plug, a compression coil spring mounted on the threaded end of the ignition rod, compressed between the rear plug and an adjustment nut on the threaded end and a lock nut on the threaded end holding the adjustment nut in a selected position;

wherein the rear plug and a portion of the electrical conductive tube extends through the igniter passage bore through the tube of the mounting bracket, and a set screw received in the threaded bore through the tube fixed to the mounting plate and with the set screw engaging the electrical conductive tube of the ground electrode assembly and holding the igniter rod portion with the igniter forward end and the hood free edge of the ground electrode assembly in a selected position relative to a burner gas discharge slot; and wherein the tube axis of the electrical conductive tube is transverse to and below the lower burner engaging surface on the mounting plate.

8. A conveyor oven igniter, as set forth in claim 7, wherein the first burner tube threaded bore, that receives the first cap screw, has a first threaded bore axis that intersects a burner axis and extends through the burner gas discharge slot in a burner tube; and the second burner tube threaded bore, that receives the second cap screw, has a second threaded bore axis that intersects the burner axis and extends through the burner gas discharge slot in the burner tube.

9. A conveyor oven igniter, as set forth in claim 7, wherein the bend in the ground rod is a ninety degree bend and has ground rod free end portion is intersected by the tube axis of the electrical conductive tube.

10. A conveyor oven igniter, as set forth in claim 1, wherein a first bend, of the at least two bends, in the ignition electrode assembly, is a ninety degree bend.

11. A conveyor oven igniter, as set forth in claim 7, wherein the conveyor oven igniter functions as a burner flame sensor when there is burning gas between the hood free edge of the ground electrode assembly and the igniter rod portion with the igniter forward end thereby forming a circuit between the ground electrode assembly and the ignition electrode assembly.

12. A conveyor oven igniter, as set forth in claim 7, wherein the front plug includes a cylindrical portion that extends into the electrical conductive tube and the electrical conductive tube is pressed inward to engage the cylindrical portion and prevent rotation of the front plug relative to the electrical conductive tube.

13. A conveyor oven igniter, as set forth in claim 12, wherein the rear plug includes a cylindrical portion that extends into the electrical conductive tube.

14. A conveyor oven igniter, as set forth in claim 7, wherein the mounting plate, of the mounting bracket, has a rear side, the tube fixed to the mounting plate includes a cylindrical tube welded to the rear side of the mounting plate below the lower burner engaging bar and the igniter passage bore through the cylindrical tube is coaxial with a mounting plate bore.

* * * * *